US005914674A

United States Patent [19]

Coleman et al.

[11] Patent Number: 5,914,674

[45] **Date of Patent: *Jun. 22, 1999**

[54] DETECTOR AND ALARM APPARATUS AND SYSTEM

[76] Inventors: Kevin R. Coleman, 134 Smith St., Leominster, Mass. 01453; Robert M. Coleman, 25 Eaton Rd. West, Framingham, Mass. 01701

[ * ] Notice: This patent issued on a continued prosecution application filed under 37 CFR 1.53(d), and is subject to the twenty year patent term provisions of 35 U.S.C. 154(a)(2).

[21] Appl. No.: 08/514,483

[22] Filed: Aug. 11, 1995

[51] Int. Cl.[6] ..... G08B 19/00; G08B 21/00

[52] U.S. Cl. ..... 340/870.09; 340/517; 340/506; 340/539; 340/825.36; 307/116

[58] Field of Search ..... 340/531, 539, 340/517, 518, 521, 506, 520, 534, 870.09, 825.06, 825.36, 825.69; 307/116

[56] References Cited

U.S. PATENT DOCUMENTS

| | | | |
|---|---|---|---|
| 4,363,031 | 12/1982 | Reinowitz | 340/539 |
| 4,367,458 | 1/1983 | Hackett | 340/539 |
| 4,417,235 | 11/1983 | Del Grande | 340/506 |
| 4,446,454 | 5/1984 | Pyle | 340/521 |
| 4,511,887 | 4/1985 | Fiore | 340/518 |
| 4,531,114 | 7/1985 | Topol et al. | 340/506 |
| 4,560,978 | 12/1985 | Lemelson | 340/534 |
| 4,725,820 | 2/1988 | Kimura | 340/517 |
| 4,951,029 | 8/1990 | Severson | 340/531 |
| 5,159,315 | 10/1992 | Schultz et al. | 340/539 |
| 5,430,433 | 7/1995 | Shima | 340/531 |
| 5,440,301 | 8/1995 | Evans | 340/518 |

*Primary Examiner*—Michael Horabik
*Assistant Examiner*—Timothy Edwards, Jr.
*Attorney, Agent, or Firm*—Damon J. Borrelli

[57] ABSTRACT

An alarm apparatus includes two sensor circuits. One of the circuits is configured to emit an audible warning upon the sensing of an adverse condition. The other circuit functions to scan for a radio signal and, when one is detected, transmit a further radio signal. The apparatus can be used alone or together with a series of other similar apparatuses to create a warning system. When used as part of a system, once one apparatus is activated due to the existence of, for example, a fire, the apparatuses produce a alarm signal and transmit a radio signal. Transmission of the subsequent radio signal is sensed by the other apparatuses of the system which, in a cascade fashion, also become activated.

8 Claims, 2 Drawing Sheets

DETECTOR AND ALARM APPARATUS AND SYSTEM

BACKGROUND OF THE INVENTION

1. Field of the Invention

The present invention relates to a detector and alarm apparatus. More particularly, it relates to a self-contained security and fire protection apparatus and system.

2. Description of the Prior Art

With the enactment of state and municipal regulations, fire protection apparatuses and systems are increasing required in both residential and commercial buildings. In response, both small self-contained, and larger computerized systems, have been developed and installed in a myriad of structures.

Self-contained detector and warning apparatuses currently available in the prior art incorporate both a sensor and an alarm. The sensor can be configured to detect heat, particulate material, or gases such as carbon monoxide. Typically, a plurality of the detection and alarm apparatuses are utilized so as to provide coverage throughout a given building. For example, in residential buildings state fire regulations typically require that these devices be dispersed throughout the premises. Most often individual units are positioned in bedrooms, living rooms, basements, and garage areas. In commercial applications, the number and position of detectors is based on the overall square footage and lay-out of the relevant building. In operation, as a unit senses, for example, heat or smoke, it will signal an alarm. Unfortunately, although these apparatuses are highly efficient they suffer from the limitation that the alarm signal may not be heard or seen due to the remoteness of a given location.

A variety of modifications and upgrades have been proposed in order to overcome the above-discussed limitation. For example, one modification includes connecting an independent signal repeater component to the main sensor/alarm unit. While such an adjunct to the basic apparatus is advantageous, it can add significant cost to the system and render it to expensive for residential applications. It has also been suggested that the units be connected in parallel. Unfortunately, it has been observed that the monitoring subsystems required by this latter modification can quickly drain those batteries used in the self-contained units. Frequent replacement of batteries increases the cost of the device over its operational life and, more importantly, can compromise safety as older batteries may not provide the voltage necessary for a unit's detector elements to remain effective.

In addition to the foregoing modifications, it has also been suggested that remote sensors be hard-wired to a centralized control station. In such a system, the control station continually monitors all of the individual units. Alternatively, a multiplexor can be used with a series of sensors connected in a loop configuration. Unfortunately, both of these systems suffer from the limitation that it is possible to incorrectly connect the units. Further, the high cost of these systems, and the continuing expense to monitor and control them, renders them inappropriate for all but the largest of buildings.

A need exists for a detector and alarm apparatus and system which is simple in construction and does not suffer from the limitations of prior devices.

SUMMARY OF THE INVENTION

It is an object of the present invention to provide a detector and alarm apparatus and system that does not suffer from the foregoing disadvantages and limitations.

It is another object of the present invention to provide a detector and alarm apparatus that is simple in construction and compact in design.

It is yet another object of the present invention to provide a detector and alarm apparatus that is easy to install and maintain.

It is yet another object of the present invention to provide a detector and alarm system utilizing the apparatus of the invention that is easy to install and maintain.

It is yet another object of the present invention to provide a detector and alarm apparatus that is easily and economically produced, and readily assembled.

Other general and specific objects of the invention will in part be obvious and will in part appear hereinafter.

The detector and alarm apparatus of the present invention is characterized generally by sensing elements, switching elements, and a warning element. A transmitting element is also normally incorporated in the apparatus of the invention. Typically, one of the sensing elements of the apparatus is configured to detect an adverse condition. The other sensor preferably functions to detect a radio signal transmittable by other detection and alarm apparatuses used in the system of the invention.

As noted above, the apparatus of the present invention includes both a first sensing element and a second sensing element. In operation, both of the elements function independent of each other. The first sensing element continuously scans the surrounding environment for an adverse condition. In the preferred embodiment of the invention, the first sensing element is configured to detect, for example, fire, smoke or a gas such as carbon monoxide. Accordingly, the first sensing element ran be a spectrographic or particulate sensor.

The second sensing element is configured to continuously scan for signal, e.g., a radio signal. Typically, the second sensing element is configured to scan only a single radio frequency. However, the element can be configured to scan as many frequencies as may be desired for a given application. The second sensing element can also include a decoding element. The decoding element is configured to decipher information encrypted by the transmitting element described below.

The apparatus of the present invention also includes a first switching element and a second switching element. The first switching element is connected to the first sensing element. The second switching element is connected to the second sensing element. In operation, the switching elements function independently. Normally, both of these elements are in a deactivated state. However, the first switching element becomes active when the first sensing element detects the relevant adverse condition, i.e., heat, smoke, or gas. The second switching element becomes active when the second sensing element detects, for example, a radio signal.

The warning element utilized in the apparatus of the present invention is connected to both the first switching element and the second switching element. The warning element becomes activated when either of the first or second switching elements are in their active states. In the preferred embodiment of the invention, upon activation, the warning element produces an audible alarm signal for a substantial period of time.

The apparatus of the present invention also includes a transmitting element. The transmitting element is connected to both the first and the second switching elements. Like these elements, the transmitting element is normally deactivated. Activation of either of the first or second switching elements causes the transmitting element emit a signal. If desired, the transmitting element can include an encoding element. When utilized, the encoding element is configured to encrypt information concerning the status and location of the apparatus of the invention.

The invention also contemplates an alarm system. The alarm system of the invention incorporates the apparatuses of the invention as described in detail above. In the system of the invention, a plurality of the apparatuses described above are dispersed in a given structure. Each unit continually scans the area in which it is positioned. In operation, upon sensing of an adverse condition, the warning element of the relevant apparatus emits an alarm. Concurrently, the transmitting element of the same apparatus emits a radio signal that is sensed by the other apparatuses making up the system of the invention. The radio signal so transmitted is then sensed by other apparatuses of the system which, in a cascade fashion, then emit an alarm and transmit a radio signal to other apparatuses.

The invention accordingly comprises the steps and apparatus embodying features of construction, combinations of elements and arrangements of parts adapted to effect such steps, as exemplified in the following detailed disclosure, the scope of the invention being indicated in the accompanying claims.

BRIEF DESCRIPTION OF THE DRAWINGS

A fuller understanding of the nature and objects of the present invention will become apparent upon consideration of the following detailed description taken in connection with the accompanying drawings in which.

DETAILED DESCRIPTION OF THE PREFERRED EMBODIMENTS

Figure 1:
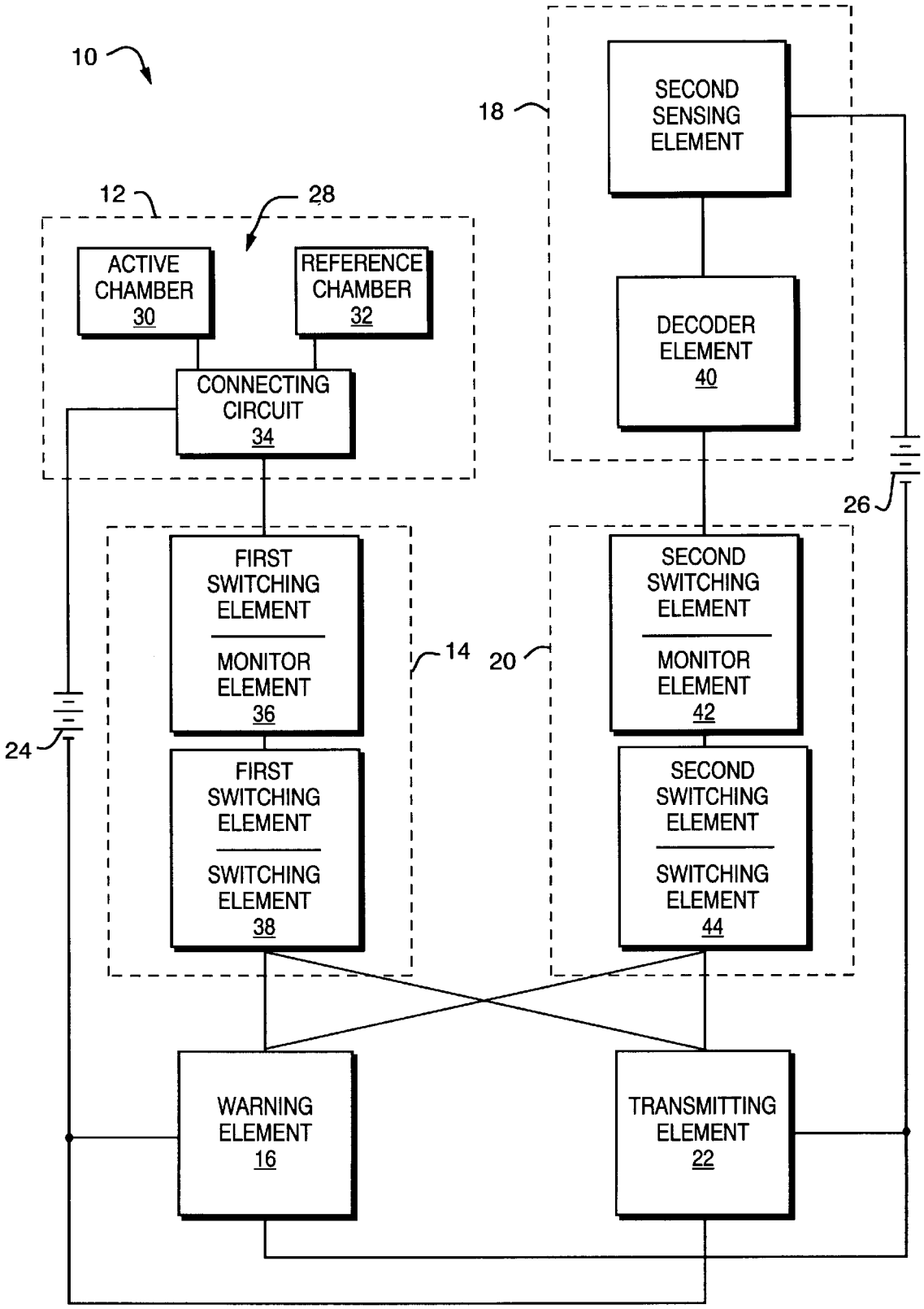
FIG. 1 is a block diagram schematically illustrating a detector and alarm apparatus embodying the present invention; and, FIG. 2 is a block diagram schematically illustrating an alarm system employing the apparatuses of the present invention.
Figure 2:
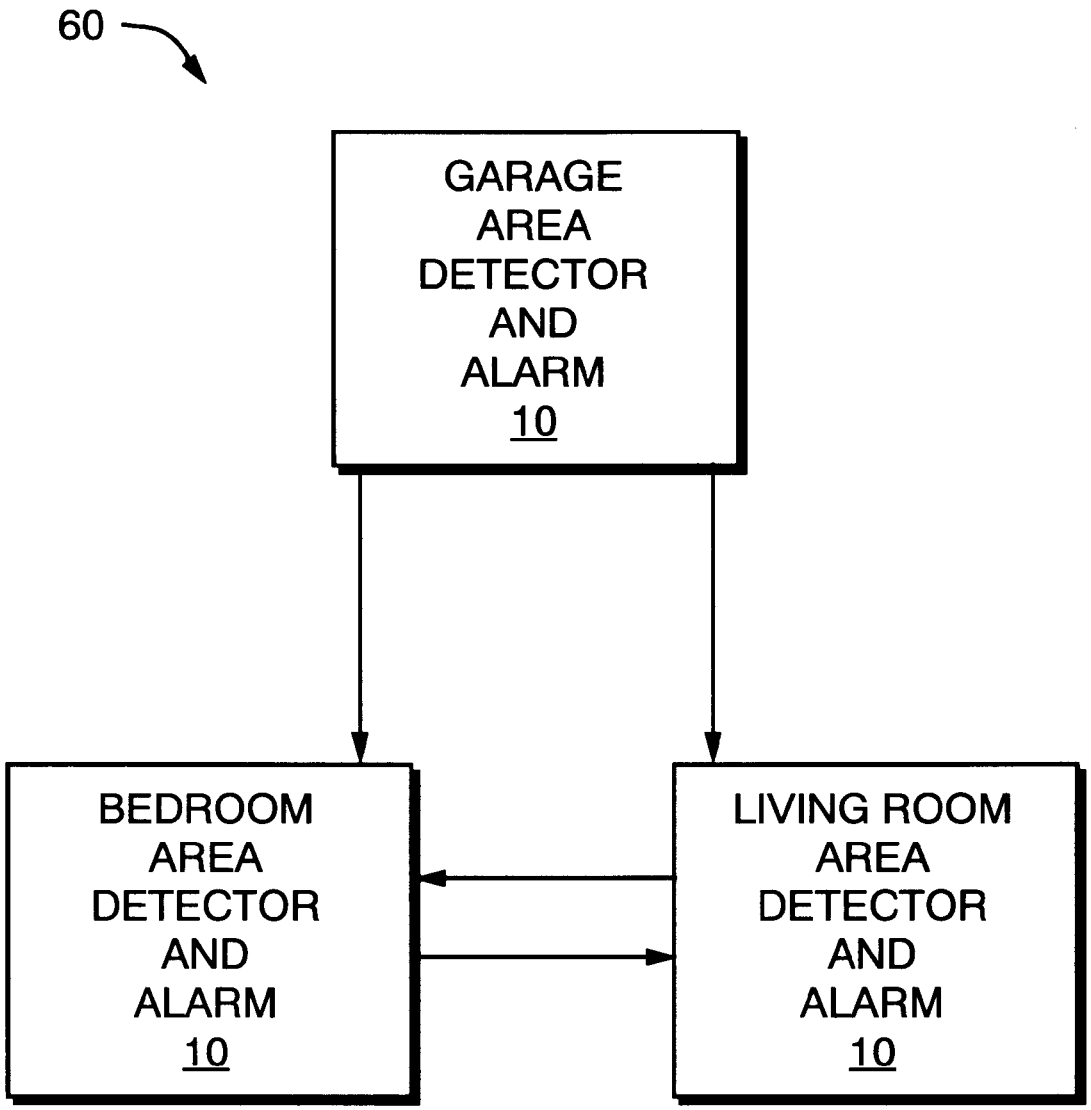

Referring now to FIGS. 1 and 2, there is shown a detector and alarm apparatus 10. The apparatus 10 includes a first sensing element 12, a first switching element 14, a warning element 16, a second sensing element 18, a second switching element 20, and a transmitting element 22. In addition, the apparatus 10 includes at least two power sources 24 and 26.

As noted in detail below, in the preferred embodiment of the invention, those circuits including the first sensing element 12 and second sensing element 18 are substantially separate. The circuits only overlap as to connections from the first switching element 14 and second switching element 20 to the warning element 16 and transmitting element 22. Preferably, each circuit has a separate power source 24 and 26. Separation of the circuits in the manner herein described provides a redundancy to the apparatus 10 so that failure of either power source 24 or 26 will not neutralize the overall operational status of the apparatus 10.

Referring now to FIG. 1, in the preferred embodiment of the apparatus of the invention 10 the first sensing element 12 continuously scans the surrounding environment for an adverse condition. Typically the first sensing element 12 is configured to detect, for example, fire, smoke, or a gas, e.g., carbon monoxide. Accordingly, the first sensing element 12 is normally a combustion, spectrographic, or particulate sensor familiar to those skilled-in-the-art.

In the preferred embodiment of the invention as depicted in FIG. 1, the first sensing element 12 is a combustion sensor. The first sensing element 12 generally includes an ionizing chamber assembly 28 comprising and active ionizing chamber 30 and a reference ionizing chamber 32. The chambers 30 and 32 may be connected by, for example, a connecting circuit 34. As those skilled-in-the-art will appreciate, the ionizing chambers 30 and 32 are configured such that as they receive air a selected electric flow is created. Dramatic changes the electric flow are monitored by the connecting circuit 34.

In operation, changes in ambient conditions affect the electric flow generated by each of the chambers 30 and 32. For naturally occurring slow changes in ambient conditions, e.g., relative humidity, barometric pressure, and temperature, the active chamber 30 and reference chamber 32 respond substantially simultaneously and the connecting circuit 34 remains balanced. For relatively rapid changes in ambient conditions, as occur with combustion, the products of combustion concentrate in the active chamber 30 much more rapidly than in the reference chamber 32. Upon entry in the active chamber 30, the products of combustion combine with the ionized air molecules therein to effect the current flow in the active chamber 30. This effect on the current flow creates an imbalance in the connecting circuit 34. This imbalance is, in turn, used as an indication of combustion in the manner described below in connection with first switching element 14.

The first switching element 14 is connected to the first sensing element 12. The first switching element 14 typically includes a monitor element 36 connected to a switching element 38. Preferably, the monitor element 36 is an electrical circuit configured to continually monitor the status of the electric flow across the connecting circuit 34. In particular, the monitor element 36 is configured so that it becomes active, and emits a signal to the switching element 38, upon the occurrence of an imbalance across the connecting circuit 34. The switching element 38 is a conventional switch familiar to those skilled-in-the-art. The switching element 38 has a first open state and a second closed state. Typically, the switching element 38 is in the open state. However, upon reception of a signal from the monitor element 36 the switching element 38 moves to its closed position.

Closure of the switching element 38 following reception of a signal from the monitor element 36 completes the circuit including the first sensing element 12, first switching element 14, warning element 16, and transmitting element 22. As a result, upon closure of the switching element 38 the warning element 16 emits an alarm signal. The transmitting element 22 also emits a radio signal in the manner described below. This action initiates, or continues, a cascade activation of other apparatuses 10 positioned within the transmission range of the transmitting element 22.

Turning to the second sensing element 18, in the preferred embodiment of the invention this component scans at least one radio frequency for a radio signal. Preferably, the second sensing element 18 is a radio receiver familiar to those skilled-in-the-art. Upon reception of a radio signal, the sensing element 18 emits a signal to the second switching element 20 described below. The second sensing element 18 can, if desired, include a decoding element 40. The decoding element 40 is configured to decipher information encrypted by the transmitting element 22 described below.

The second switching element 20 is connected to the second sensing element 18. The second switching element 20 typically includes a monitor element 42 connected to a switching element 44. Preferably, the monitor element 42 is an electrical circuit configured to continually monitor the status of the second sensing element 18. In particular, the monitor element 42 is configured so that it becomes active, and emits a signal to the switching element 44, when the second sensing element 18 emits a signal as a result of the reception of a transmission from another apparatus 10. The switching element 44 is a conventional switch familiar t o those skilled-in-the-art. The switching element 44 has a first open state and a second closed state. Typically, the switching element 44 is in the open state. However, upon reception of a signal from the monitor element 42 the switching element 44 moves to its closed position.

Closure of the switching element 44 in the manner described above completes that circuit including the second sensing element 18, second switching element 20, and both the warning element 16 and transmitting element 22. As a result, upon closure of the switching element 44 the warning element 16 emits an alarm signal while the transmitting element 22 emits a radio signal. This action again initiates, or continues, a cascade activation of other apparatuses 10 positioned within the transmission range of the transmitting element 22.

The warning element 16 has a configuration familiar to those skilled-in-the-art. As noted above, the warning element 16 is connected to both the first switching element 14 and the second switching element 20. The warning element 16 becomes activated, and emits an audible signal, when either the first switching element 14 or the second switching element 20 emit a signal. In the preferred embodiment of the invention, upon activation, the warning element 16 produces an audible alarm signal at about 85 decibels at a frequency of about 2,500 to 3,000 Hertz, for a substantial period of time.

The transmitting element 22 is a radio transmitter having a configuration familiar to those skilled-in-the-art. The transmitting element 22 becomes activated, and emits a signal, when either the first switching element 14 or the second switching element 20 emits a signal. Upon activation, the transmitting element 22 produces a signal for a substantial period of time. In the preferred embodiment of the invention as shown in FIG. 1, the transmitting element 22 includes an encoding element. The encoding element encrypts the transmission from the transmitting element 22 so that it can only be understood by apparatuses 10 including the decoding element 40. The encoding element is often utilized in order to avoid false alarm signals due to cross-communication between other non-related alarm mechanisms. If desired, additional data can be encrypted in the transmission from transmitting element 22 concerning, for example, the location of the apparatus 10 signalling the alarm.

Referring to FIG. 2, the invention also) contemplates a system 60 utilizing a plurality of the apparatuses 10. The apparatuses 10 are as described in detail above. In the system 60 of the invention, the apparatuses 10 are dispersed in a given structure. Each apparatus 10 continually scans the area in which it is positioned for a given adverse condition, e.g., fire, smoke, gaseous concentration. Upon sensing of an adverse condition, the warning element 16 of the relevant apparatus 10 emits an audible alarm. Concurrently, the transmitting element 22 of the same apparatus 10 emits a radio signal that is sensed by the second sensing elements 18 of other apparatuses 10 making up the system 60 of the invention. This causes the other apparatuses 10 to become active and emit both an alarm signal and a radio transmission. These secondary radio signals are then sensed by other apparatuses 10 of the system 60. As those skilled-in-the-art will appreciate, this sequential activation creates a cascade which causes, eventually, all apparatuses 10 in the structure to become activated.

It will be understood that changes may be made in the above construction and in the foregoing sequences of operation without departing from the scope of the invention. It is accordingly intended that all matter contained in the above description or shown in the accompanying drawings he interpreted as illustrative rather than in a limiting sense.

It is also to be understood that the following claims are intended to cover all of the generic and specific features of the invention as described herein, and all statements of the scope of the invention which, as a matter of language, might be said to fall therebetween.

What is claimed is:

1. A de-centralized alarm apparatus, said alarm apparatus consisting of:

a.) a first sensor, said first sensor consisting of a first sensing means only in electrical communication with a first independent switching means;

1.) said first sensing means of said first sensor being configured to continuously scan for an adverse condition, said first sensing means emitting a signal only upon detection of said adverse condition, said signal being emitted only to said first independent switching means;

2.) said first independent switching means of said first sensor electrically connected to said first sensing means of said first sensor, said first independent switching means of said first sensor and said first sensing means of said first sensor forming a first, self-contained circuit, said first independent switching means including a monitor means and a switching means, said monitor means in electrical connection with said first sensing means and said switching means, said monitor means continuously monitoring said first sensing means for production of said signal by said first sensing means, said production of said signal indicating the occurrence of said adverse condition, said monitor means only emitting a signal to said switching means of said first independent switching means of said first sensor, said switching means being in a deactivated state when said monitor means of said first independent switching means does not detect said signal from said first sensing means and does not emit a signal, said switching means of said first independent switching means of said first sensor being in an active state when said monitor means emits said signal upon reception of said signal from said first sensing means indicating the detection of said adverse condition by said first sensing means of said first sensor;

b.) a second sensor, said second sensor consisting of a second sensing means, a decoding means, and a second independent switching means, said second sensing means being in electrical communication only with said decoding means, said decoding means being in electrical communication only with said second sensing means and said second independent switching means;

1.) said second sensing means of said second sensor being configured to continuously scan a selected frequency for at least one radio signal, said radio signal containing encrypted information;

2.) said decoding means only in direct electrical communication with said second sensing means and said second independent switching means, said decoding means being configured to decode said information encrypted in said radio signal, said decoding means emitting a signal upon deciphering of said encrypted information received over said frequency scanned by said second sensing means;

3.) said second independent switching means of said second sensor electrically connected to said decoding means of said second sensor, said second independent switching means of said second sensor, said decoding means, and said second sensing means of said second sensor forming a second, self-contained circuit, said second switching means of said second sensor including a monitor means and a switching means, said monitor means in electrical connection with said decoder means and said switching means, said monitor means continuously monitoring said decoder means for production of said signal indicating the reception of said encrypted information over said selected frequency, said monitor means only emitting a signal to said switching means of said second independent switching means, said switching means being in a deactivated state when said monitor means of said second independent switching means does not detect said signal from said decoder means and emit said signal to said switching means of said second sensor, said switching means of said second independent switching means being in an active state when said radio signal is sensed by said second sensing means of said second sensor and said decoding means is able to decode said encrypted information in said radio signal and produce said signal to said monitor means and said monitor means emits said signal to said switching means of said second independent switching means;

c.) a warning means in electrical communication with both said switching means of said first independent switching means of said first circuit of said first sensor and said switching means of said second independent switching means of said second circuit of said second sensor, said warning means being activated when either of said switching means of said first independent switching means or switching means of said second independent switching means are in said active states, said warning means including a means for producing an audible alarm signal when said warning means is activated;

d.) a transmitting means in direct electrical communication with both said switching means of said first independent switching means of said first circuit of said first sensor and said switching means of said second independent switching means of said second circuit of said second sensor, said transmitting means being adapted to continuously transmit encrypted information in the form of a radio signal when either of said switching means of said first independent switching means or switching means of said second independent switching means are in said active states; and, e.) an encoding means in direct electrical communication with said transmitting means, said encoding means encrypting information for transmission by said transmitting means.

2. The apparatus of claim 1 wherein said adverse condition sensed by said first sensing means is heat.

3. The apparatus or claim 1 wherein said adverse condition sensed by said first sensing means is the concentration of particulate products of combustion.

4. The apparatus of claim 1 wherein said adverse condition sensed by said first sensing means is a selected concentration of carbon monoxide.

5. A multiple device alarm system, said alarm system having a de-centralized configuration, said alarm system including at least two alarm subunits, each of said subunits consisting of:

a.) a first sensor, said first sensor consisting of a first sensing means only in electrical communication with a first independent switching means;

1.) said first sensing means of said first sensor being configured to continuously scan for an adverse condition, said first sensing means emitting a signal only upon detection of said adverse condition, said signal being emitted only to said first independent switching means;

2.) said first independent switching means of said first sensor electrically connected to said first sensing means of said first sensor, said first independent switching means of said first sensor and said first sensing means of said first sensor forming a first, self-contained circuit, said first independent switching means including a monitor means and a switching means, said monitor means being in electrical connection with said first sensing means and a switching means, said monitor means continuously monitoring said first sensing means for production of said signal by said first sensing means, said production of said signal indicating the occurrence of an adverse condition, said monitor means only emitting a signal to said switching means of said first independent switching means of said first sensor, said switching means being in a deactivated state when said monitor means of said first independent switching means does not detect said signal from said first sensing means and does not emit said signal, said switching means of said first independent switching means of said first sensor being in an active state when said monitor means emits a signal upon reception of a signal from said first sensing means indicating the detection of said adverse condition by said first sensing means of said first sensor;

b.) a second sensor, said second sensor consisting of a second sensing means, a decoding means, and a second independent switching means, said second sensing means being in electrical communication only with said decoding means, said decoding means being in electrical communication only with said second sensing means and said second independent switching means;

1.) said second sensing means of said second sensor being configured to continuously scan a selected frequency for a radio signal transmitted by the other of said subunits, said radio signal containing encrypted information;

2.) said decoding means only in direct electrical communication with said second sensing means and said second independent switching means, said decoding means being configured to decode said information encrypted in said radio signal, said decoding means emitting a signal upon deciphering of said encrypted information received over said frequency scanned by said second sensing means;

3.) said second independent switching means of said second sensor electrically connected to said decoding means of said second sensor, said second independent switching means of said second sensor, said decoder means, and said second sensing means of said second sensor forming a second, self-contained circuit, said second switching means of said second sensor including a monitor means and a switching means, said monitor means in electrical connection with said decoder means and said switching means, said monitor means continuously monitoring said decoder means for production of said signal indicating the reception of said encrypted information over said selected frequency, said monitor means only emitting a signal to said switching means of said second independent switching means, said switching means being in a deactivated state when said monitor means of said second independent switching means does not detect said signal from said decoder means and emit said signal to said switching means of said second sensor, said switching means of said second independent switching means being in an active state when said radio signal is sensed by said second sensing means of said second sensor and said decoding means is able to decode said encrypted information in said radio signal and produce said signal to said monitor means and said monitor means emits said signal to said switching means of said second independent switching means;

c.) a warning means in electrical communication with both said switching means of said first independent switching means of said first circuit of said first sensor and said switching means of said second independent switching means of said second circuit of said second sensor, said warning means being activated when either of said switching means of said first independent switching means or said switching means of said second independent switching means are in said active states, said warning means including a means for producing an audible alarm signal when said warning means is activated;

d.) a transmitting means in direct electrical communication with both said switching means of said first independent switching means of said first circuit of said first sensor and said switching means of said second independent switching means of said second circuit of said second sensor, said transmitting means being adapted to continuously transmit encrypted information in the form of a radio signal from one of said subunits to the other of said subunits when either of said switching means of said first independent switching means of said first circuit of said first sensor or switching means of said second independent switching means of said second circuit of said second sensor are in said active states; and, e.) an encoding means in direct electrical communication with said transmitting means, said encoding means encrypting information for transmission by said transmitting means.

6. The apparatus of claim 5 wherein said adverse condition sensed by said first sensing means is heat.

7. The apparatus of claim 5 wherein said adverse condition sensed by said first sensing means is the concentration of particulate products of combustion.

8. The apparatus of claim 5 wherein said adverse condition sensed by said first sensing means is a selected concentration of carbon monoxide.

* * * * *